US006182830B1

(12) United States Patent
Au et al.

(10) Patent No.: US 6,182,830 B1
(45) Date of Patent: Feb. 6, 2001

(54) DISPLAYABLE JEWELLERY BOX

(75) Inventors: Ho Ching Au, Hong Kong; Juan Qiang Siao, Dong Guan, both of (HK)

(73) Assignee: Nationalpak Limited, Guang Dong (CN)

( * ) Notice: Under 35 U.S.C. 154(b), the term of this patent shall be extended for 0 days.

(21) Appl. No.: 09/422,873

(22) Filed: Oct. 21, 1999

(30) Foreign Application Priority Data

Nov. 12, 1998 (CN) ..... 98123334

(51) Int. Cl.[7] ..... A45C 11/04; B65D 5/50
(52) U.S. Cl. ..... 206/762; 206/6.1; 206/765
(58) Field of Search ..... 206/45.2, 45.23, 206/756, 758, 759, 765, 6.1, 18, 301, 762

(56) References Cited

U.S. PATENT DOCUMENTS 1,247,848 * 11/1917 List .
2,118,507 * 5/1938 Guttman .
3,262,558 * 7/1966 Abend et al. .
3,942,632 * 3/1976 Witkoff ..... 206/45.2
4,396,119 * 8/1983 Giulie ..... 206/45.23
4,666,036 * 5/1987 Bourbon ..... 206/45.23
5,579,906 * 12/1996 Fabbri et al. ..... 206/301

* cited by examiner

*Primary Examiner*—David T. Fidei
(74) *Attorney, Agent, or Firm*—Raymond Y. Chan; David and Raymond

(57) ABSTRACT

The present invention relates to a displayable jewellery box, and particularly to the packaging, storage, and display for gifts such as watches, jewelleries, glasses, cosmetics, including a box and a cover and providing less storage space, inexpensive manufacturing cost, and able to stand out the feature of the product.

16 Claims, 4 Drawing Sheets

DISPLAYABLE JEWELLERY BOX

BACKGROUND OF THE PRESENT INVENTION

1. Field of Invention

The present invention relates to displayable jewellery box and particularly to the packaging, storage, and display for gifts such as watches, jewelleries, glasses, cosmetics, etc.

2. Description of Related Arts

Conventionally, there are two kinds of displayable jewellery box: one's cover is linked to the box, thereof the side and back view of the product cannot be seen when it is displayed. Moreover, this kind of display wastes lots of space storage. Another one's cover can be separated from the box. While the product is displayed, the cover is separated from its box. By the way, it is inconvenient to place and is easy to lose the cover. Sometimes people clip the cover at the side of the box for convenience while displaying. However, the box has a restricted size, is difficult to manufacture, and is costly. People want to show their product to customers with the best view especially when the product is delicate and fine, such as jewellery. In addition, people want best protection for storage.

According to most available jewellery boxes, salesman takes lots of time in packaging, sometimes they even cannot find the right cover to its box. So, people always have conflict between packaging and displaying. Ignoring the right packaging may depreciate the value of the product as well.

SUMMARY OF THE PRESENT INVENTION

The present invention relates to a displayable jewellery box that the cover can flip over and slide in order to improve the inadequacy of existing jewelry box. The product can be placed horizontally or at a certain angle for promotion while displaying. The box protects the product while storing or packaging. It prevents product from getting dusty as well.

The present invention relates to a displayable jewellery box wherein the displayable jewellery box comprises a box and a cover. Tracks are placed on two inner side planes of the box, and pegs are placed on two outer side panels of the cover. These pegs correspond to the tracks and can rotate and slide inside the tracks freely.

Tracks on two inner side panels of the box are parallel to each other and correspond to the pegs on two outer side panels of the cover.

Various tracks on two inner side panels of the box are structured either parallel, perpendicular, or at a slanted angle to the bottom plane of the box.

Cover can be concave down or lay flat.

The front and the back panels on the concave cover cooperate with the front and the back panels on the box.

The flat panel is made up of one or more pieces of boards.

The upper parts of two inner side panels are situated parallel tracks and these tracks correspond to the bars on two outer side panels of the cover.

A piece of supporting board is placed at the front end of the cover and is connected to the cover.

There are three kinds of installation for display inside the box and/or the cover. These installations can be clipped, assembled, or adhered.

The corners of the jewellery box are right angle, round, and cut.

Pillars are placed on the open end of two side panels and correspond to the opening of the box.

The advantages of the present invention are:

The present invention provides an alternative style to display the product. The display can be placed flat or at a slanted angle while the cover is flipped or slide-in.

The present invention provides a full protection to the product and prevents product from getting dusty.

The structure of present invention is simple and reliable. The cover is easy to slide in and out, flip-over, or open. Additionally, its advantages include less storage space, inexpensive manufacturing cost, and able to stand out the feature of the product. It is convenient for customers to enjoy and carry the product, especially for package of watches, jewelleries, glasses, cosmetics, etc.

DETAILED DESCRIPTION OF THE PREFERRED EMBODIMENT

Figure 1:
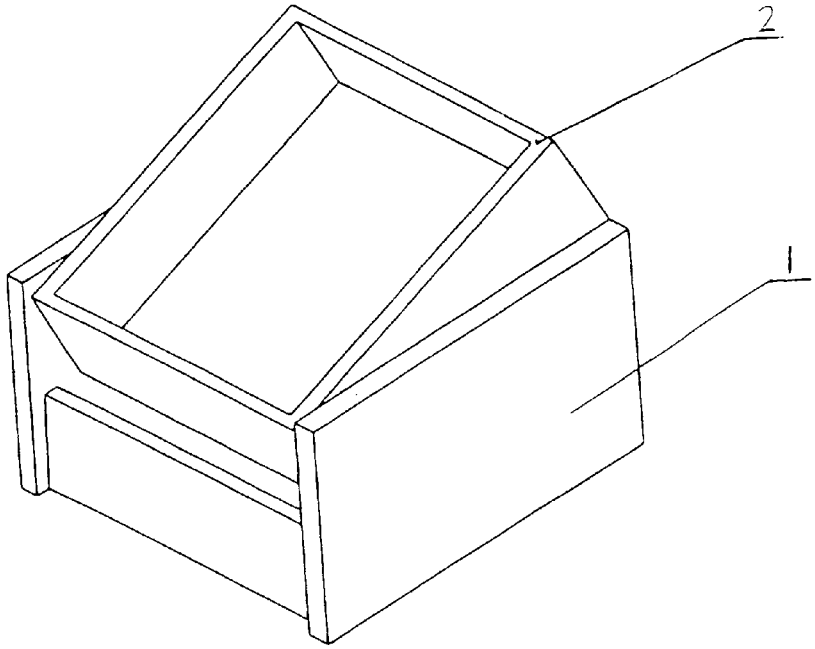
FIG. 1 is one example of perspective view in displayable jewellery box according to a preferred embodiment of the present invention.
Figure 2:
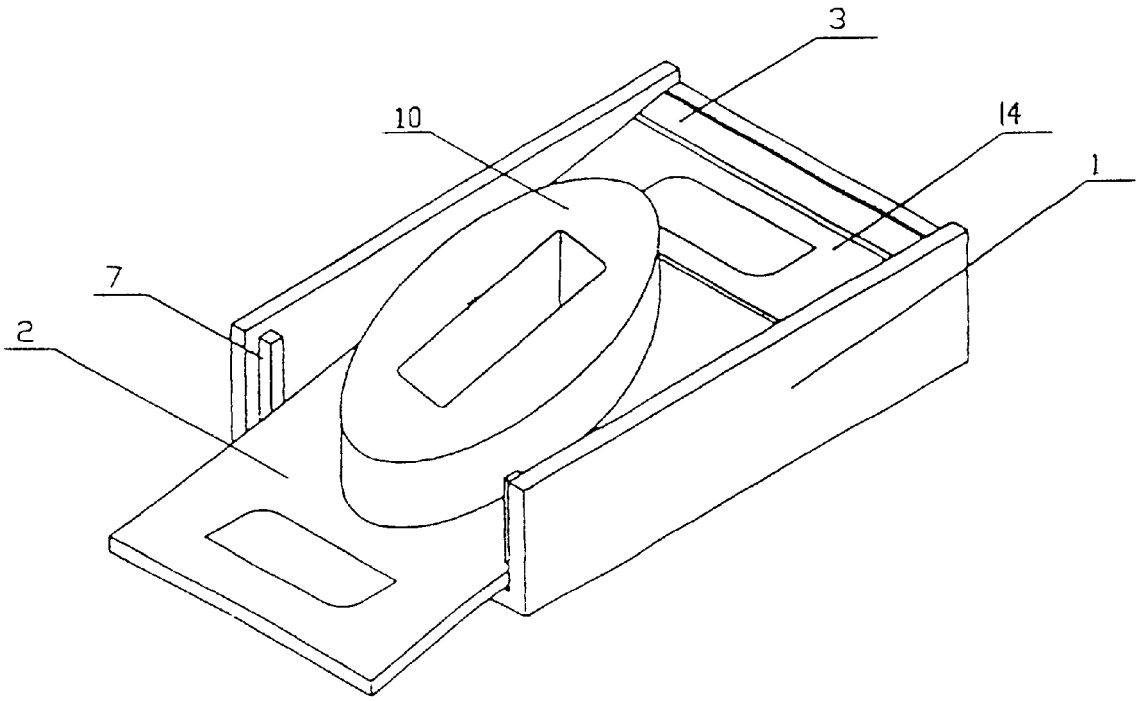
FIG. 2 is another example of perspective view in the displayable jewellery box according to the above preferred embodiment of the present invention.
Figure 4:
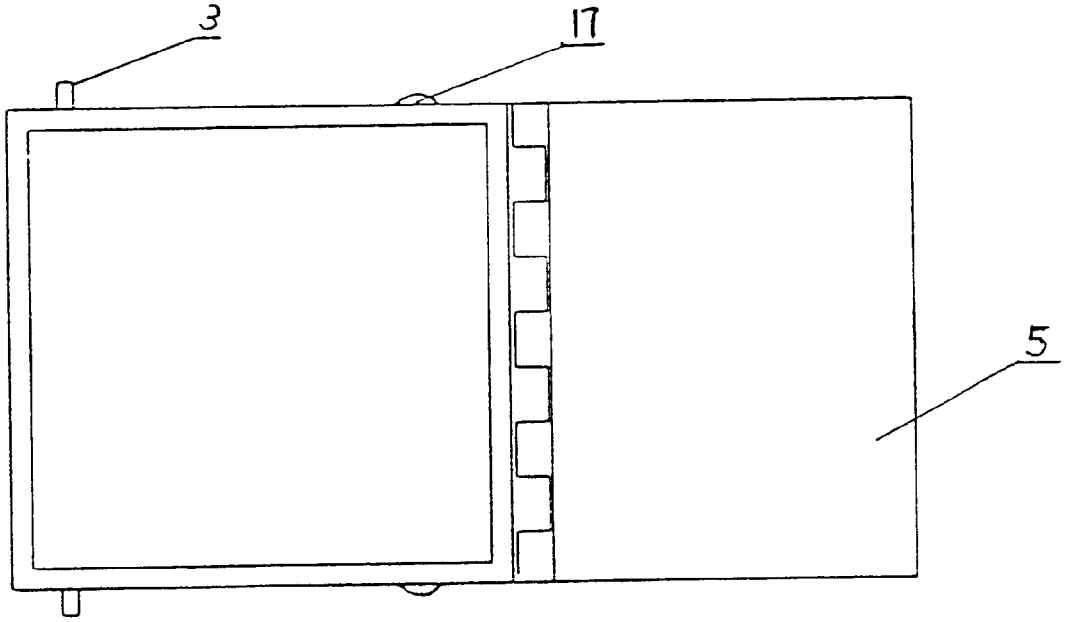
FIG. 4 is one example of figurative view of the displayable jewellery box according to the above preferred embodiment of the present invention.

The drawings disclose illustrative embodiments of the present invention which serves to exemplify the object. FIGS. 1, 2, and 4 illustrate the stages in storage and display of the present invention respectively. FIGS. 1 and 4 illustrate the box and the cover without adhesive layer or frame.

The following paragraphs provide illustrations and descriptive manual of the present invention:

When opening the box, hold the front and back panels of the box 1, and flip the front and back panels of the cover 2 to the back. The bars 17 on two outer side panels of the cover 2 will separate from the grooves 16 on two inner side panels of the box 1. While the cover 2 is flipped over, the cover 2 will slide along the tracks 4 until it reaches the blocked end of the tracks. The display is formed by arranging the box 1 and the cover 2.

When closing the box, hold the front panel of the cover 2. Pull and flip the cover 2 back along the tracks 4 until the bars 17 on two outer side panels of the cover 2 slide back to the grooves 16 on two inner side panels of the box 1, so it will be back to a closed position. The cover 2 of the present invention will close tightly to prevent product from getting dusty. The shiny surface of the box also allows product display to customer with the best view.

Figure 3:
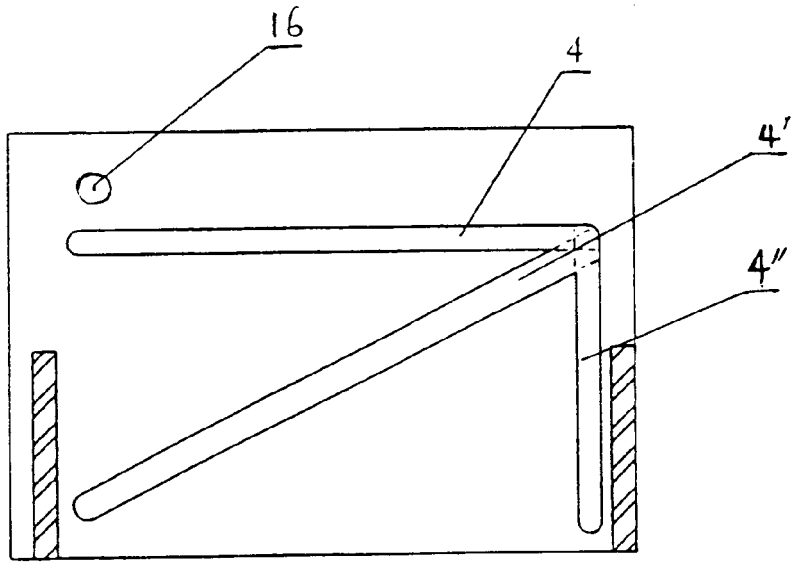
FIG. 3 is a partially cutaway view of displayable jewellery box according to the above preferred embodiment of the present invention.

FIG. 3 is a partially cutaway view of the box 1, each panel at two ends of the box 1 can be half-open. Parallel tracks on two corresponding inner side planes are adjusted to the pegs 3 on the cover 2 from rotating and sliding freely. The length of the track 4 cannot exceed the front and back end panels.

Referring to FIG. 3, there are three directions of tracks on two inner side panels corresponding to the box 1. The tracks 4 are parallel to the bottom plane, the tracks 4' are at slanted angle to the bottom plane, and the tracks 4" are perpendicular to the bottom plane. With these different directions of tracks, the product can be displayed at different angles to stand out its feature. Three different directions of the track are shown in FIG. 3. For convenience, the hidden line shown in the figure indicates there is the same starting point for three different directions of the tracks.

When the tracks 4 on two inner side panels are perpendicular to the bottom plane of the box 1, the length of two side panels of the box 1 should be greater or equal to its width in order to put the cover 2 perpendicularly into the box 1.

Referring to FIG. 4, the front end of the cover 2 can install a piece of supporting board 5. When the box is used for storage, the supporting board 5 can cover the gap between the box 1 and the cover 2. When the box is used for displaying, the supporting board 5 will support the box on the drawer and allow the cover to be placed at a slanted angle. Then, the product displayed on the cover will also offer a slanted view, and will satisfy the need of different styles of display.

When for a flat cover 2, the cover can be directly opened the cover for product display. A side pocket is placed inside the cover 2 for carrying the instruction manual. Furthermore, the product can be taken out from the box 1 including the base and put on the cover 2 which is flipped and set already.

Figure 5:
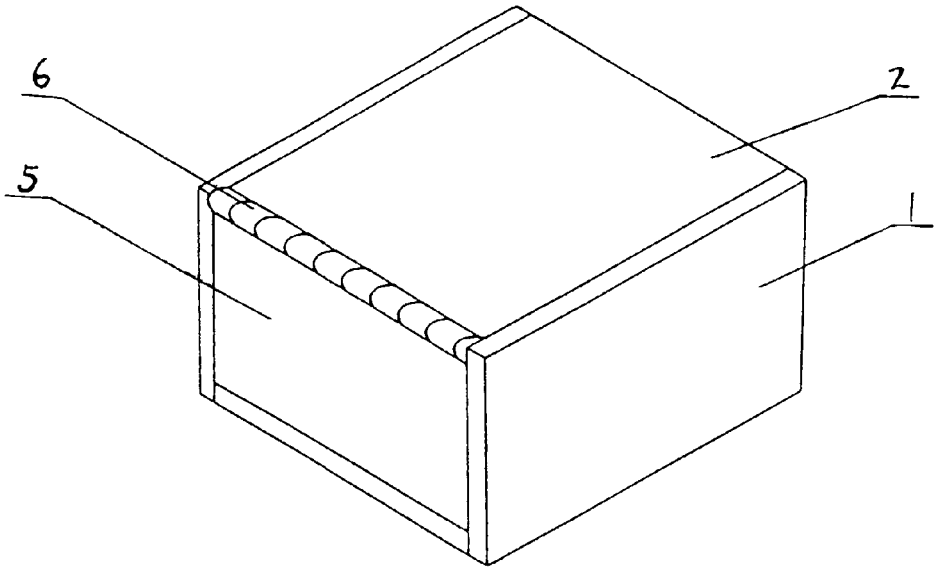
FIG. 5 is a perspective view of the displayable jewellery box according to the above preferred embodiment of the present invention, illustrating the box is in the stage for storage.

FIG. 5 is a figurative view of the displayable jewellery box wherein the box is used for storage. The hinge is a joint to connect the supporting board 5 and the cover 2 together.

Figure 6:
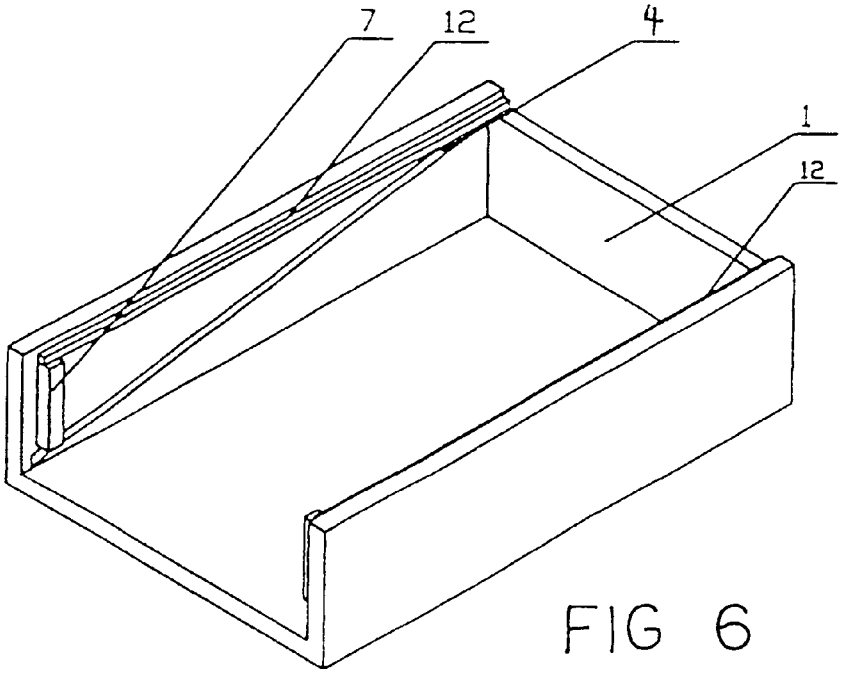
FIG. 6 is a perspective view of the displayable jewellery box's body according to the above preferred embodiment of the present invention.

Referring to FIG. 6, at the open end, the slanted cover can slide back and forth on parallel tracks 4 at the two corresponding inner side planes. Moreover, the base can be lifted up for a better view of the product. At one ends of the tracks 4 are blocked by a stopper while the other ends can be either blocked or not. It is convenient to slide the cover 2 into the track 4 with only one end of the track is blocked. When both ends of the tracks are blocked, the bent peg 3 can be installed into the track 4. The height of stopper should be less or equal to the depth of the track. In order to keep the shape of the box for storage, pillars 7 placed on the open end of two side panels will support the side panel 14 of the cover 2 when the box is closed.

Figure 7:
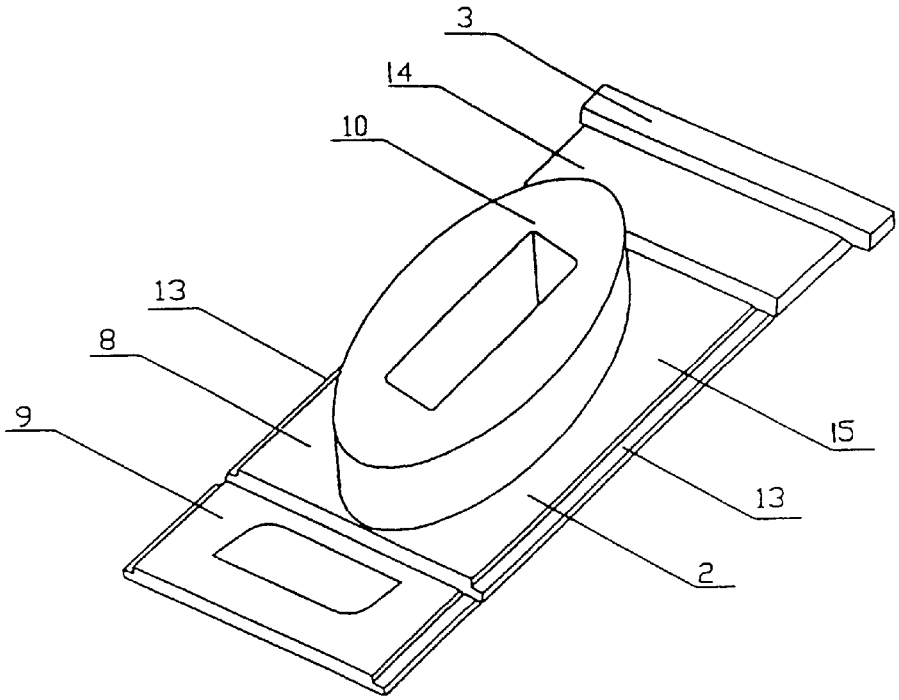
FIG. 7 is a perspective view of the displayable jewellery box's cover according to the above preferred embodiment of the present invention.
Figure 8:
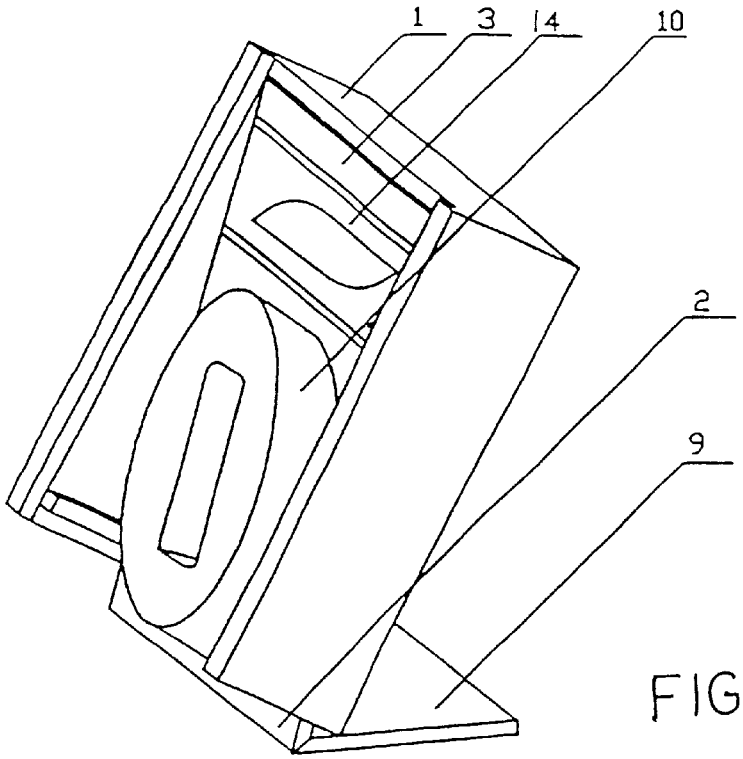
FIG. 8 is another figurative view of the displayable jewellery box of the box according to the above preferred embodiment of the present invention.

Referring to FIG. 7, the cover 2 comprises pegs 3, a side panel 14, and a three-piece of front plane 15. The narrow bar-shape pegs 3 are mainly use for jointing the box 1 and the cover 2. Side panel 14 is connected between the pegs 3 and the front panel 15. When three parts combine into one piece, it becomes a box-shaped side part of the box 1. When the box 1 and the cover 2 collide together, the edges of the cover 2 will easily indent. So, two side panels of the box 1 and two side-edges of the cover 2 have grooves 12 and 13 respectively for protection (as shown in FIGS. 7 and 8). These grooves 12 and 13 correspond to each other.

The front plane 15 is mainly used for display. There is a stage on the front plane 15 that offers clipping, assembling, and adhering installations. Furthermore, a base 10 can be placed on the stage for supporting different variety, structure, size, and design of products. The product can be clipped, sticked, or screwed onto the base 10 and can be placed flat or at a slanted angle for display. The height and shape of the product is coordinated to the volume of the box 1.

A lock is placed at the front end of the front plane 15 of the cover 2 which the lock is manufactured of clip, button, or magnet. For special needs, the product can be placed at a greater slanted angle for display. The front plane 15 can be bent into two parts. One part is called front-end plane 8 and other is called secondary plane 9. The front plane 15 can be bent backward to the box 1 and the base is affixed on the front plane 15 at a slanted angle by the hinge (as shown in FIG. 8).

The folding lines of the joint between the pegs 3, the side planes 14, and the front plane 15, and the joint between the secondary plane 9 and the front plane 15 are designed either at the middle or on the side. The hinge will be used as a joint to support the box at a slanted angle. For the best result, the hinge with a right angle will be used.

When display, flip the pegs 3 on the cover back, and slide the cover 2 along the tracks 4 on two inner side planes of the box 1 horizontally or at a slanted angle. The product on the cover will be displayed horizontally or at a slanted angle as well. When storing, follow the direction above inversely.

After the box is manufactured, an artistic decoration such as metal plates or cotton goods can be placed on the surfaces of the box. Additionally, use an advertisement or an instruction manual to set off the product is an alternative method for decoration.

The concept of the present invention is diverse. The box can be square or rectangular. The corners of the box are right angle, round, and cut. We will not discus further in here.

What is claimed is:

1. A displayable jewellery box, comprising:

a box having a top opening and a pair of elongated slanted tracks indented on two inner surface of two parallel side panels of said box respectively, each of said slanted tracks inclinedly extending from an upper portion of a rear end of said respective side panel to a lower portion of a front end of said respective side panel, wherein each of said slanted tracks has a rear blocked end and a front blocked end positioned at said rear end and said front end of said respective side panel respectively;

a cover having a pair of pegs formed on two outer surfaces of two parallel cover side panels respectively, each of said pegs being outwardly and perpendicularly protruded from an upper portion of a rear end of said respective cover side panel, a distance between said two outer surfaces of said two cover side panels of said cover being slightly smaller than a distance between said two inner surfaces of said two cover side panels, wherein said two cover side panels of said cover are placed between and adjacent to said two side panels of said box while said two pegs provided on said two outer surfaces of said two cover side panels of said covers are slidably inserted into said two slanted tracks provided on said two inner surfaces of said two side panels of said box respectively, wherein said two pegs are stopped and positioned at said two rear blocked ends of said two slanted tracks respectively while said cover is arranged to cover said top opening of said box; and a display base, which is affixed at a bottom surface of said cover for mounting a product to be stored and displayed, therefore when said cover is arranged to cover said top opening of said box, said base is disposed inside said box and covered by said cover, wherein to open said box for displaying said product, flip a front side of said cover over to up side down said cover until said display base is placed on top and then slide said cover frontwardly until said pair of pegs of said covers are slid to position at said two front blocked ends of said two side panels of said box and said cover is rest in said box.

2. A displayable jewellery box, as recited in claim 1, wherein said box further having a pair of circular grooves provided at two upper portions of said front ends of said inner surfaces of said two side panels thereof respectively, and said cover further having a pair of circular bars slightly protruded on two upper portions of said front ends of said outer surfaces of said two cover side panels thereof respectively, wherein said pair of bars are made to be capable of sliding into said pair of grooves respectively so as to tightly close up said cover and said box.

3. A displayable jewellery box, as recited in claim 1, wherein said box further has a pair of horizontal tracks indented on two inner surface of said two side panels of said box respectively, each of said horizontal tracks horizontally extending from said rear blocked ends of said slanted track provided on said respective side panel to an upper portion of a front end of said respective side panel to form a front blocked end of said horizontal track, wherein said two pegs of said cover are arranged to be capable of sliding in said two horizontal tracks of said box respectively.

4. A displayable jewellery box, as recited in claim 2, wherein said box further has a pair of horizontal tracks indented on two inner surface of said two side panels of said box respectively, each of said horizontal tracks horizontally extending from said rear blocked ends of said slanted track provided on said respective side panel to said upper portion of a front end of said respective side panel to form a front blocked end of said horizontal track, wherein said two pegs of said cover are arranged to be capable of sliding in said two horizontal tracks of said box respectively.

5. A displayable jewellery box, as recited in claim 1, wherein said box further has a pair of vertical tracks indented on two inner surface of said two side panels of said box respectively, each of said vertical tracks horizontally extending from said rear blocked ends of said slanted track provided on said respective side panel to a lower portion of said rear end of said respective side panel to form a bottom blocked end of said vertical track, wherein said two pegs of said cover are arranged to be capable of sliding in said two vertical tracks of said box respectively.

6. A displayable jewellery box, as recited in claim 2, wherein said box further has a pair of vertical tracks indented on two inner surface of said two side panels of said box respectively, each of said vertical tracks horizontally extending from said rear blocked ends of said slanted track provided on said respective side panel to a lower portion of said rear end of said respective side panel to form a bottom blocked end of said vertical track, wherein said two pegs of said cover are arranged to be capable of sliding in said two vertical tracks of said box respectively.

7. A displayable jewellery box, as recited in claim 3, wherein said box further has a pair of vertical tracks indented on two inner surface of said two side panels of said box respectively, each of said vertical tracks horizontally extending from said rear blocked ends of said slanted track provided on said respective side panel to a lower portion of said rear end of said respective side panel to form a bottom blocked end of said vertical track, wherein said two pegs of said cover are arranged to be capable of sliding in said two vertical tracks of said box respectively.

8. A displayable jewellery box, as recited in claim 4, wherein said box further has a pair of vertical tracks indented on two inner surface of said two side panels of said box respectively, each of said vertical tracks horizontally extending from said rear blocked ends of said slanted track provided on said respective side panel to a lower portion of said rear end of said respective side panel to form a bottom blocked end of said vertical track, wherein said two pegs of said cover are arranged to be capable of sliding in said two vertical tracks of said box respectively.

9. A displayable jewellery box, as recited in claim 1, wherein said cover further comprises a supporting board hingedly connected at a front side of said cover, said supporting board is adapted to folded up to support said box while said cover is placed at a slanted angle.

10. A displayable jewellery box, as recited in claim 2, wherein said cover further comprises a supporting board hingedly connected at a front side of said cover, said supporting board is adapted to folded up to support said box while said cover is placed at a slanted angle.

11. A displayable jewellery box, as recited in claim 3, wherein said cover further comprises a supporting board hingedly connected at a front side of said cover, said supporting board is adapted to folded up to support said box while said cover is placed at a slanted angle.

12. A displayable jewellery box, as recited in claim 4, wherein said cover further comprises a supporting board hingedly connected at a front side of said cover, said supporting board is adapted to folded up to support said box while said cover is placed at a slanted angle.

13. A displayable jewellery box, as recited in claim 5, wherein said cover further comprises a supporting board hingedly connected at a front side of said cover, said supporting board is adapted to folded up to support said box while said cover is placed at a slanted angle.

14. A displayable jewellery box, as recited in claim 6, wherein said cover further comprises a supporting board hingedly connected at a front side of said cover, said supporting board is adapted to folded up to support said box while said cover is placed at a slanted angle.

15. A displayable jewellery box, as recited in claim 7, wherein said cover further comprises a supporting board hingedly connected at a front side of said cover, said supporting board is adapted to folded up to support said box while said cover is placed at a slanted angle.

16. A displayable jewellery box, as recited in claim 8, wherein said cover further comprises a supporting board hingedly connected at a front side of said cover, said supporting board is adapted to folded up to support said box while said cover is placed at a slanted angle.

* * * * *